United States Patent [19]

de Belaunde

[11] Patent Number: 4,858,251

[45] Date of Patent: Aug. 22, 1989

[54] PRESSURIZED WATER CISTERN WITH FLOATING VALVE

[76] Inventor: Alfredo de Belaunde, Avenida Pardo 975, Depto. 502, Miraflores, Lima 18, Peru

[21] Appl. No.: 121,559

[22] Filed: Nov. 17, 1987

[51] Int. Cl.[4] ..... E03D 3/10; E03D 1/35

[52] U.S. Cl. ..... 4/358; 4/398; 4/411; 4/414

[58] Field of Search ..... 4/353, 354, 355, 356, 4/357, 358, 359, 394, 395, 396, 397, 398, 399, 400, 401, 403, 411, 413, 414

[56] References Cited

U.S. PATENT DOCUMENTS

| | | | |
|---|---|---|---|
| 369,003 | 8/1887 | Harvey | 4/357 |
| 375,353 | 12/1887 | Harvey | 4/356 |
| 658,161 | 9/1900 | Shapiro | 4/354 |
| 997,560 | 7/1911 | Kelly | 4/354 |
| 1,047,510 | 12/1912 | Fraser | 4/356 |
| 1,102,469 | 7/1914 | Brett | 4/354 |
| 1,245,738 | 11/1917 | Koenig | 4/354 |
| 1,518,990 | 12/1924 | Lisson | 4/354 |
| 1,995,358 | 3/1935 | Mace | 4/356 |
| 2,502,262 | 3/1950 | Labiche | 4/362 |
| 2,628,362 | 2/1953 | Birkmaier | 4/396 |
| 2,709,264 | 5/1955 | Stierlen | 4/398 |
| 3,107,747 | 10/1963 | Parkison | 4/353 |
| 3,117,323 | 1/1964 | Corsaw | 4/400 |
| 3,934,276 | 1/1976 | Karlsson et al. | 4/366 |
| 4,185,339 | 1/1980 | Morales | 4/398 X |
| 4,233,698 | 11/1980 | Martin | 4/354 |

FOREIGN PATENT DOCUMENTS

| | | | |
|---|---|---|---|
| 0500196 | 1/1951 | Belgium | 4/354 |
| 1111426 | 2/1956 | France | 4/396 |
| 30207 | of 1898 | United Kingdom | 4/355 |
| 20781 | 9/1909 | United Kingdom | 4/357 |
| 428335 | 11/1933 | United Kingdom | 4/354 |

*Primary Examiner*—Henry J. Recla
*Assistant Examiner*—Daniel Stein-Freer
*Attorney, Agent, or Firm*—Sprung Horn Kramer & Woods

[57] ABSTRACT

A pressurized flushing cistern for a water closet comprising a container with a bottom discharge opening, a liquid inlet conduit for admitting liquid into the container, the inlet conduit having an outlet disposed within the container at an upper portion of the container, an opening having an outlet valve seat connecting a lower portion of the container to the discharge opening, a flushing valve for closing the valve seat, the flushing valve comprising a floating valve member disposed in a chamber, the chamber closed at one end thereof where the chamber is connected to the bottom discharge opening and a manually operable activating means for unseating the flushing valve, the activating means comprising a lever device to raise the floating valve member within the chamber.

4 Claims, 4 Drawing Sheets

PRESSURIZED WATER CISTERN WITH FLOATING VALVE

BACKGROUND OF THE INVENTION

Field of the Invention

The present invention concerns a pressurized flushing cistern, especially for water closets.

Background Information

At the beginning of this century, the following patents described flushing cisterns for water closets: U.S. Pat. Nos. 658,161; 997,560; 1,102,469 and 1,245,738.

A latter device for a flushing tank is described in U.S. Pat. No. 2,502,262.

Conventional flushing cisterns for water closets generally comprise a refilling valve, a float having an operating arm, a bottom valve provided with a lift stem, and an overflow. An alternative to such conventional flushing cisterns was proposed in U.S. Pat. No. 3,934,276.

Heretofore flushing cisterns for water closets suffered from frequent malfunction of the inflow valve and its controlling float, and cumbersome operation of springs or complicated mechanisms associated with such cisterns.

SUMMARY OF THE INVENTION

It is an aim of the present invention to provide a flushing cistern for a water closest with a virtual foolproof flushing operation.

It is another aim of the present invention to reduce, as much as possible, the number of metallic parts in cisterns, which parts are subject to oxidation and water corrosion.

It is a further aim of this invention to provide for ease of replacement of as few as possible wearable parts in a flushing cistern.

It is still further aim of the present invention to provide a flushing cistern for a water closet that can be economically manufactured.

The above aims, as well as other aims, goals and advantages are satisfied by the present invention concerning a pressurized flushing cistern for a water closet comprising a container with a bottom discharge opening, a liquid inlet conduit for admitting liquid into the container, the inlet conduit having an outlet disposed within the container at an upper portion of the container, an opening having an outlet valve seat connecting a lower portion of the container to the discharge opening, a flushing valve for closing the valve seat, the flushing valve comprising a floating valve member disposed in a chamber, the chamber closed at one end thereof where the chamber is connected to the bottom discharge opening and a manually operable activating means for unseating the flushing valve, the activating means comprising a lever device to raise the floating valve member within the chamber.

DETAILED DESCRIPTION OF THE INVENTION

Figure 1:
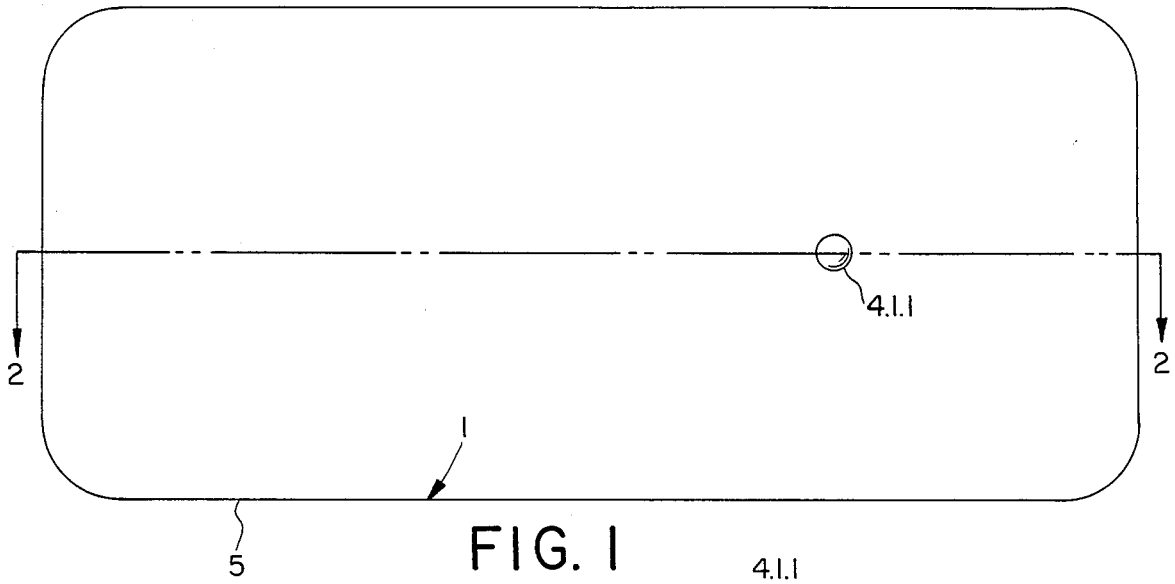
FIG. 1 is a top plan view of a pressurized flushing cistern for a water closet according to the present invention.

Referring to the drawings in detail, wherein like numerals indicate like elements, there is depicted in FIG. 1 a pressurized flushing cistern 1 for a water closet according to the present invention composed of container 5 for holding liquid, e.g., water. The cistern 1 is depicted in greater detail in FIG. 2 wherein there is shown an elongate inlet pipe 2 which enters the container 5 at the lower portion thereof. The inlet pipe is connected to a liquid, e.g., water, supply line (not shown). The inlet pipe (conduit) 2, which is disposed within container 5, has an opening 2.1, which opening 2.1 is disposed at an upper portion of the container 5 in order to avoid drainage in case of reduction of liquid pressure. The opening 2.1 allows for the admission of liquid, e.g., water, into the container 5.

Figure 2:
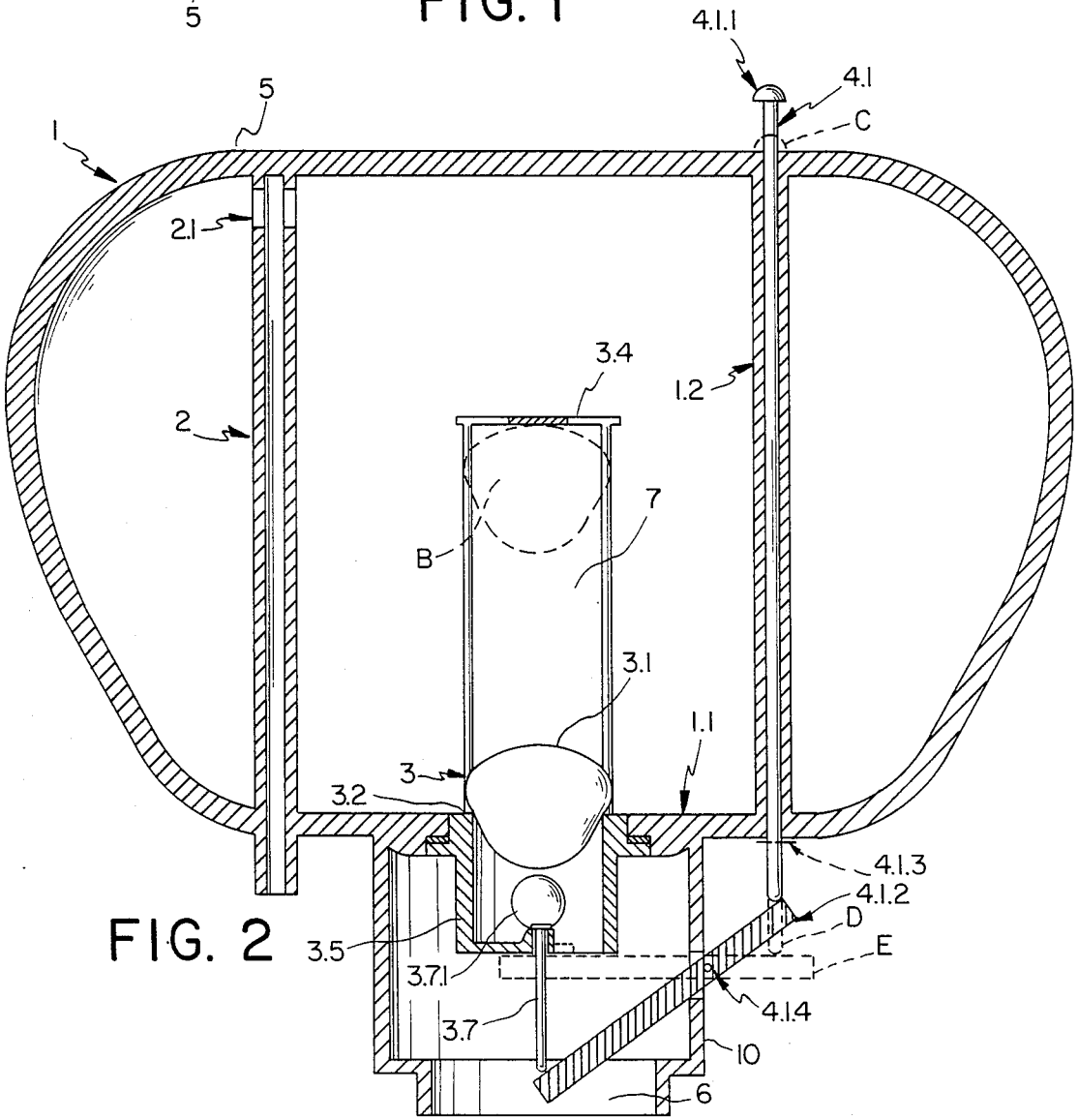
FIG. 2 is a partial cross-sectional view of a pressurized flushing cistern for a water closet taken along line 2—2 of FIG. 1.

The flushing mechanism 3 depicted in FIG. 2 comprises a floating valve member 3.1 which is disposed in a chamber 7 having a top cover 3.4. Valve member 3.1 engages socket 3.2 at the lower portion of container 5 when the flushing mechanism is in a closed position. Valve member 3.1 is movable within chamber 7 to an upper position B wherein the valve member 3.1 engages top cover 3.4 of chamber 7.

A manually operated flushing activation means is depicted in FIG. 2. Such means comprises elongate stem 4.1 which is disposed within the container 5 in an elongate channel 1.2, which isolates the elongate stem 4.1 from the liquid in container 5. At the top of the elongate stem 4.1 is knob 4.1.1, which in its depressed conditon C rests against the outside top of container 5. At a lower end of elongate stem 4.1 is retainer ring 4.1.3 (see FIG. 10) which is disposed through elongate stem 4.1 between the outside bottom end of container 5 and lever arm 4.1.2. The fully depressed condition of elongate stem 4.1 is indicated in FIG. 2 by D. The activating means also includes lever arm 4.1.2 which contacts the lower end of elongate stem 4.1. The lever arm 4.1.2 is pivoted at fulcrum 4.1.4 on the wall of cylinder 10 which is attached to and extends below container 5. At the lower end of cylinder 10 is discharge opening 6. Lifter 3.7 is disposed through the center of flushing mechanism chamber (cylinder nut) 3.5. At the top of the lifter 3.7 is a resetting weight 3.7.1 in the shape of a sphere. The weight 3.7.1 comes into contact with floating valve member 3.1. The bottom of weight 3.7.1 is in contact with the bottom inside wall of chamber 3.5 when the weight 3.7.1 is in its lowest position. The bottom wall of container 5 has a thickened section 1.1 which can be thread connected to the flushing mechanism.

When one pushes down on knob 4.1.1, the knob travels to position C, which in turn moves elongate stem 4.1 downward to position D, which in turn moves lever arm 4.1.2 downward to position E, which in turn moves lifter 3.7 and resetting weight 3.7.1 upward to move floating valve member 3.1 into position B.

Figure 3:
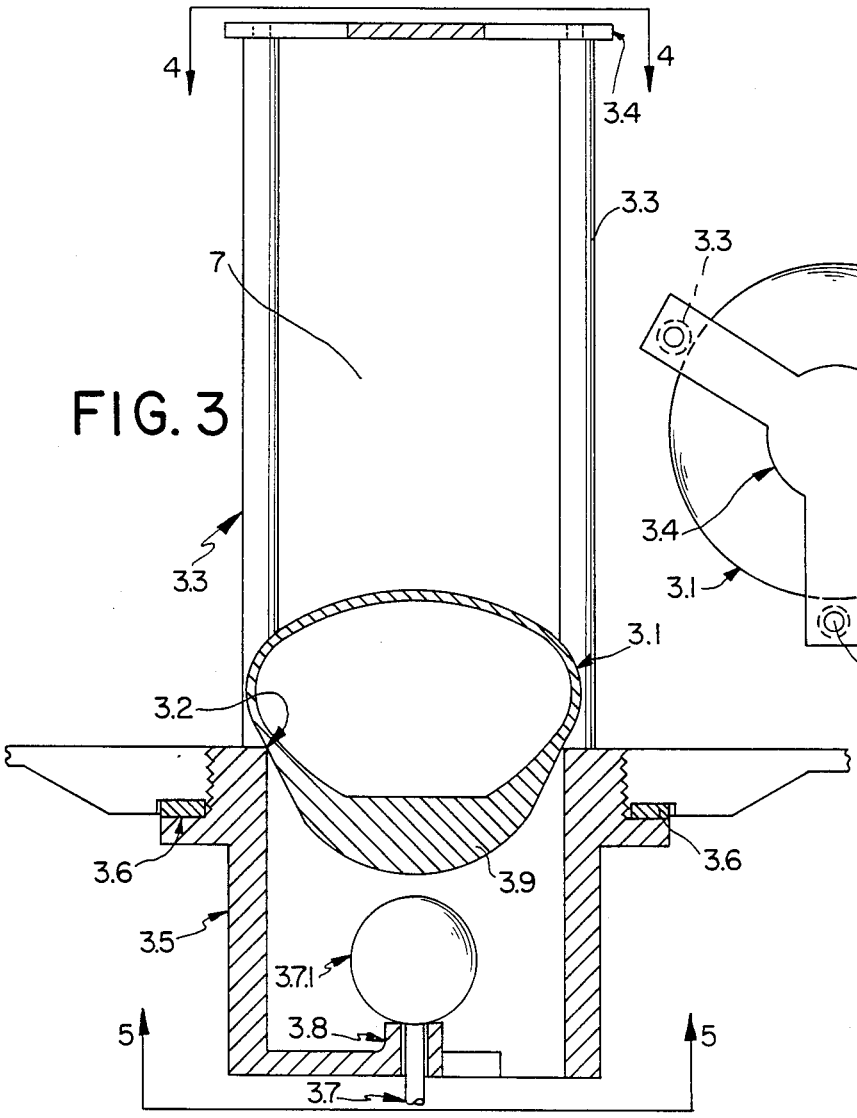
FIG. 3 is a partial cross-sectional view of a flushing mechanism for a pressurized flushing cistern for a water closet according to the present invention.
Figure 4:
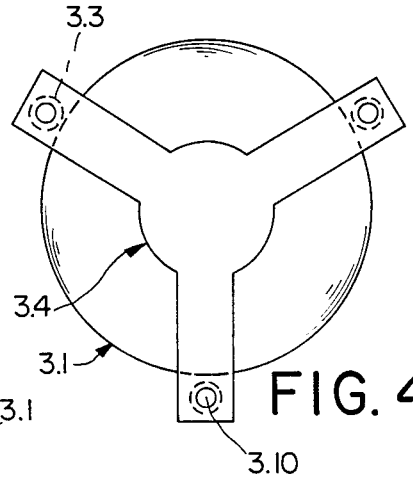
FIG. 4 is a top plan view taken along line 4—4 of the flushing mechanism depicted in FIG. 3.
Figure 5:
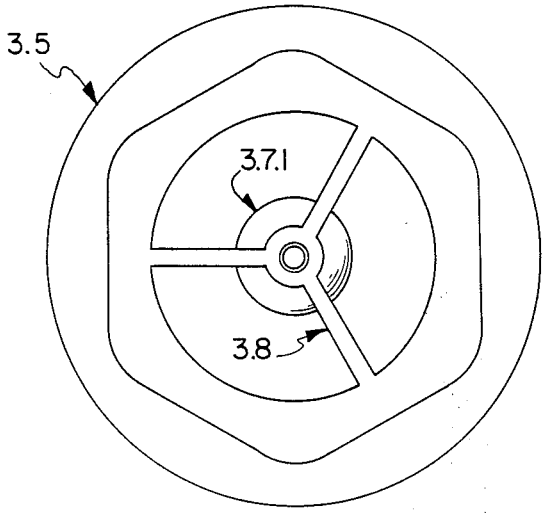
FIG. 5 is a bottom plan view taken along line 5—5 of the flushing mechanism depicted in FIG. 3.

FIGS. 3, 4 and 5 depict a flushing mechanism, approximately of its actual size, for use in the present invention.

In FIG. 3, floating valve member 3.1 is depicted as a hollow body. Such floating valve member 3.1 can be made from metal or plastic. The floating valve member 3.1 has its weight concentrated at the bottom thereof. Hollow socket 3.2 is located above the weighted portion 3.9 of floating valve member 3.1. the chamber 7 is composed of a tripod guide 3.3 which is connected to top cover 3.4 by screws 3.10 (see FIG. 4). Tripod-guide 3.3 at its lower end thereof is rigidly connected to cylinder nut 3.5 that connects the flushing mechanism to the container 5, which is rendered liquid-tight by gaskets 3.6. FIG. 5 depicts a tripod support guide 3.8 for supporting weight 3.7.1. Such guide 3.8 for supporting weight 3.7.1 being integrated onto cylinder nut 3.5.

Figure 7:
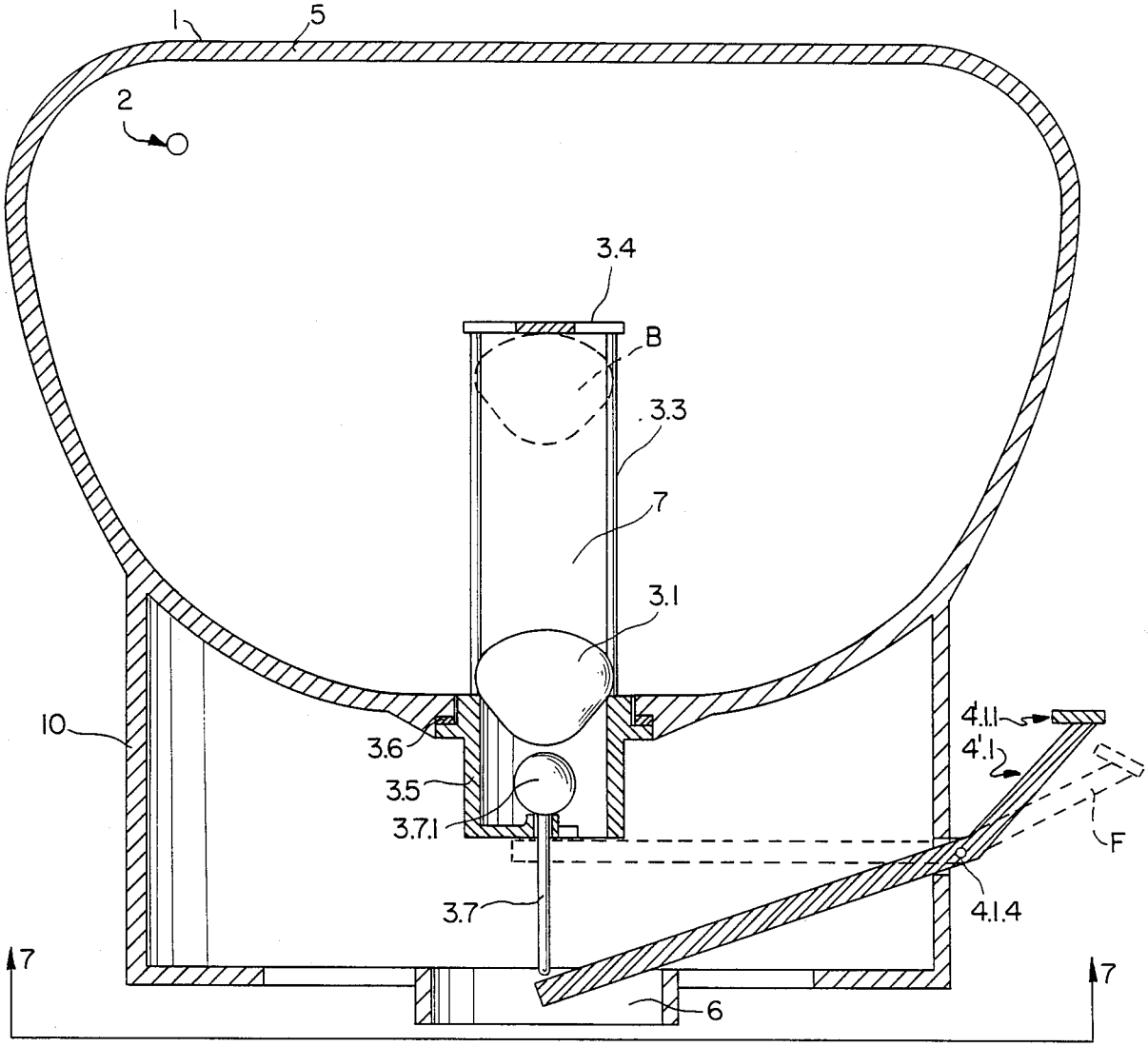
FIG. 7 is a partial cross-sectional view of the alternative embodiment of a pressurized flushing cistern for a water closet according to the present invention taken along line 7—7 of FIG. 6.
Figure 6:
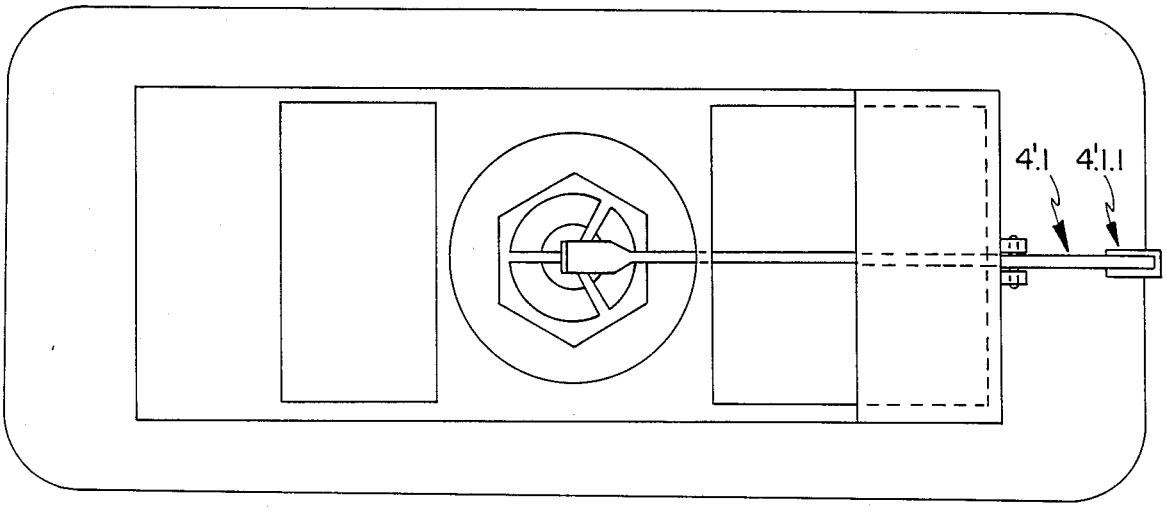
FIG. 6 is a bottom plan view of an alternative embodiment of a pressurized flushing cistern for a water closet according to the present invention.

To reduce the cost of the cistern and die, an alternative design is depicted in FIGS. 6 and 7, wherein water inlet 2 is disposed at an upper end of container 5 and wherein the lever device to raise and lower the floating valve member 3.1 has a different embodiment from that depicted in FIG. 2. Lever arm 4'.1 has an upper portion with a handle 4'.1.1 at the top thereof. The upper portion is at an angle of about 30° from the alignment of its lower portion, with the angle measured at pivot point 4'.1.4. The lever arm 4'.1 is disposed through cylinder 10. Lever handle 4'.1.1 is disposed below the bottom of container 5. When one presses down on handle 4'.1.1 at its fullest extent, position F of lever arm 4'.1 is attained which moves lifter 3.7 and weight 3.7.1 upward to move floating valve member 3.1 into position B.

Figure 8:
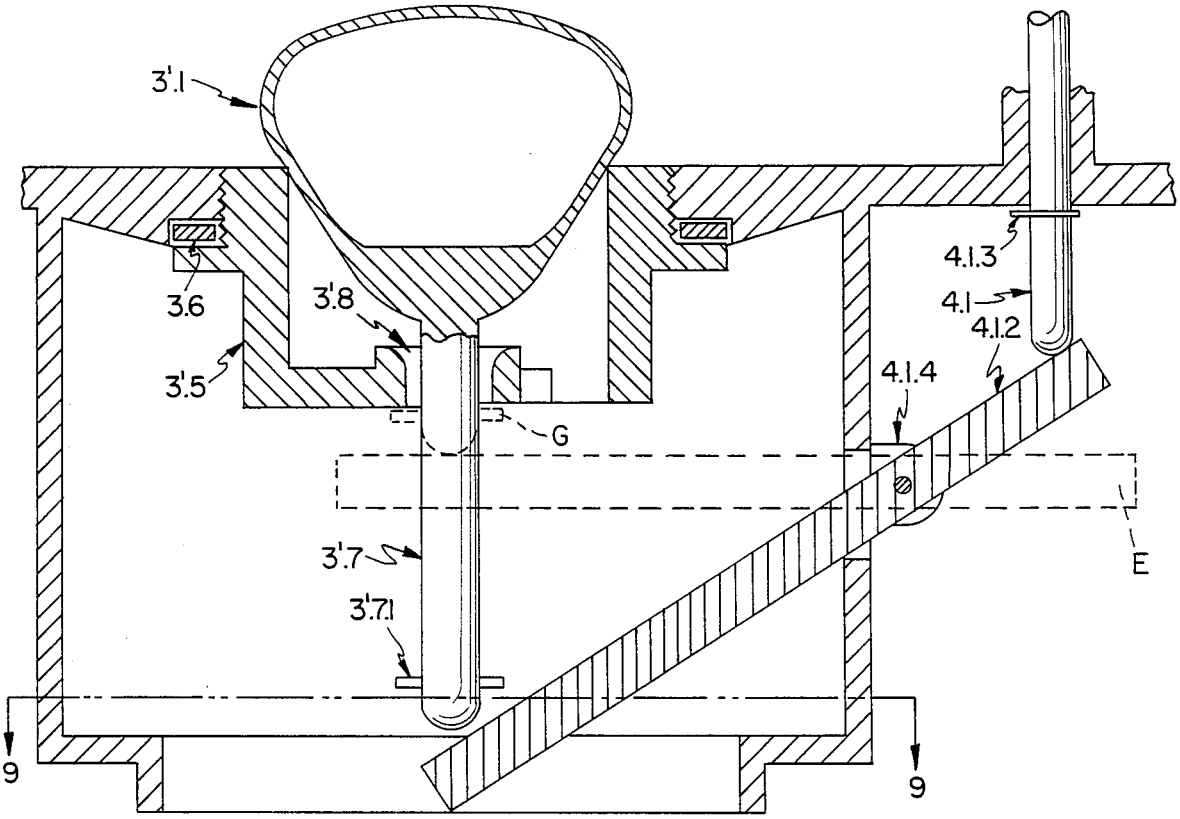
FIG. 8 is a partial cross-sectional view of a flushing mechanism for a pressurized flushing cistern for a water closet according to the present invention.
Figure 9:
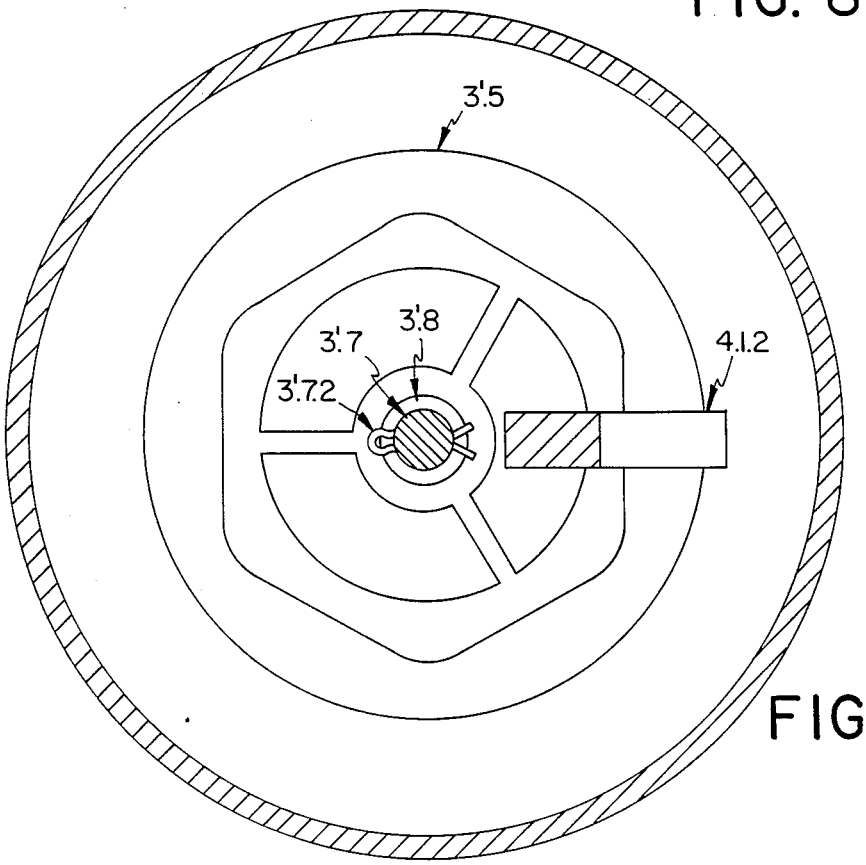
FIG. 9 is a bottom plan view taken along line 9—9 of the flushing mechanism depicted in FIG. 8.

FIGS. 8 and 9 depict a further embodiment of a flushing mechanism according to the present invention, wherein the tripod guide 3.3 forming the chamber 7 as depicted in FIG. 3 is not required. In FIG. 8, stem 3'.7 having flushing valve member 3'.1 on the top thereof has a pin 3'.7.2 disposed therethrough at its lower end thereof. Such pin 3'.7.2, e.g., a cotter pin, acting as a stop in position G. The hole in the middle of the bottom of cylinder nut 3'.5 wherein stem 3'.7 is disposed therethrough is enlarged at 3'.8 to permit enough lateral movement to achieve as perfect as possible fit for floating valve 3'.1 in its socket. The necessary limitation of up-lift is obtained as indicated by position G.

The parts for the water cistern of the present invention can be made from any conventional material such as metal, plastic or ceramic. The particular material, thickness and shape of parts for the present invention will be determined to a large degree by the water pressure the system is designed for.

The floating valve 3.1 normally rests on its socket 3.2, due to the distribution of its weight and the guiding rods of the tripod 3.3 (or the lifter design as depicted in FIG. 9). If the cistern is filled with water up to the level established by the pressure in the inlet or feeding pipe, the depression of the knob 4.1.1, or the lever handle 4'1.1, will move the floating valve member up to the top (3.4) of the tripod guide (or lifter in FIG. 9). As the level of water goes down, the valve will follow it and adjust to its socket, stopping the flush when the cistern is almost empty (approximately 1 to 1.5 inches of water).

Figure 10:
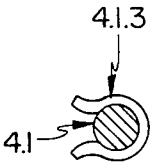
FIG. 10 is a bottom plan view of an elongate activating stem as shown in FIGS. 2 and 5.

FIGS. 8 and 10 depict the elongate stem 4.1 having a retainer ring 4.1.3 at the bottom end thereof and wherein the retainer ring 4.1.3 is disposed between the outside bottom end of the container and the lever arm 4.1.2, whereby the retainer ring 4.1.3 acts as a stop.

It will be appreciated that the instant specification and claims are set forth by way of illustration and not limitation and that various modifications and changes may be made without departing from the spirit and scope of the present invention.

What is claimed is:

1. A pressurized flushing cistern for a water closet comprising a container with a bottom discharge opening, a liquid inlet conduit for admitting liquid into the container, the inlet conduit having an outlet disposed within the container at an upper portion of the container, an opening having an outlet valve seat connecting a lower portion of the container to the discharge opening, a flushing valve for closing said valve seat, said flushing valve comprising a floating valve member disposed in a chamber, said floating valve member having a concentration of weight at the bottom end thereof, said chamber connected to the bottom discharge opening, said chamber comprising an elongate tripod guide having a cover on the top thereof and a manually operable activating means for unseating said flushing valve, said activating means for raising the floating valve member within said chamber, the activating means comprising an elongate stem including a knob on the top end thereof, the stem being disposed in a channel in the container so as to isolate the stem from the liquid, the knob being disposed on the outside of the upper end of the container, a pivoted lever arm that contacts the bottom end of the stem and is movable by the stem and an elongate lifter arm which on the bottom end thereof contacts the lever arm and is movable by the lever arm, the top end of the lifter arm contacting the floating valve member, said lifter arm having a spherical resetting weight on the top end thereof which contacts the floating valve member, wherein the elongate stem has a retainer ring at the bottom end thereof, said ring disposed between the outside bottom end of the container and the lever arm, said ring acting as a stop.

2. A pressurized flushing cistern according to claim 1, wherein a flushing mechanism chamber is rigidly connected to the bottom of the container, said lifter being disposed through the center of said flushing mechanism chamber.

3. A pressurized flushing cistern according to claim 1, wherein the floating valve member is a hollow body.

4. A pressurized flushing cistern according to claim 1, wherein the lifter arm is supported by a tripod guide.

* * * * *